US007329216B2

(12) United States Patent
Boldrini et al.

(10) Patent No.: US 7,329,216 B2
(45) Date of Patent: Feb. 12, 2008

(54) SYSTEM FOR MANUFACTURING CONTAINERS

(75) Inventors: Fulvio Boldrini, Ferrara (IT); Roberto Ghiotti, Calderino Di Monte San Pietro (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/521,152

(22) PCT Filed: Jul. 14, 2003

(86) PCT No.: PCT/IB03/03205

§ 371 (c)(1),
(2), (4) Date: Jan. 13, 2005

(87) PCT Pub. No.: WO2004/011237

PCT Pub. Date: Feb. 5, 2004

(65) Prior Publication Data

US 2005/0266975 A1 Dec. 1, 2005

(30) Foreign Application Priority Data

Jul. 25, 2002 (IT) ..... BO2002A0484

(51) Int. Cl.
*B31B 1/04* (2006.01)

(52) U.S. Cl. ..... 493/71; 493/68; 493/157; 493/162; 493/175

(58) Field of Classification Search ..... 493/62, 493/68–72, 69, 59, 133, 155–157, 162, 164, 493/165, 175, 181
See application file for complete search history.

(56) References Cited

U.S. PATENT DOCUMENTS 2,748,833 A 6/1956 Monroe et al.

(Continued)

FOREIGN PATENT DOCUMENTS

CH 413339 5/1966

(Continued)

*Primary Examiner*—Hemant M. Desai
(74) *Attorney, Agent, or Firm*—Timothy J. Klima

(57) ABSTRACT

A system (1) for manufacturing containers (5) is designed around a supporting structure (2) with which all the stations (7, 18, 19, 21, 24, 25) and the devices (14, 15, 16, 17, 20, 22, 26) needed to produce the containers are associated. The system (1) is equipped with a feed station (7) supplying a forming material (9), a scoring station (18) by which crease lines (4*a*) are generated, and a cutting station (19), combining to prepare a succession of blanks (4). The system (1) also includes a prefolding station (21) where each blank (4) is bent initially along the creases lines (4*a*), a folding station (24) where the single blank (4) is fashioned to the shape of the container (5), and a sealing or welding station (26) at which the shape of the container (5) is fixed definitively.

24 Claims, 4 Drawing Sheets

U.S. PATENT DOCUMENTS

| | | | | | |
|---|---|---|---|---|---|
| 3,068,761 | A | | 12/1962 | Engleson et al. | |
| 3,304,193 | A | | 2/1967 | Dollheimer | |
| 4,044,528 | A | * | 8/1977 | Black et al. | 53/575 |
| 4,732,027 | A | * | 3/1988 | Traczyk et al. | 72/133 |
| 4,788,811 | A | * | 12/1988 | Kawajiri et al. | 53/426 |
| 4,979,932 | A | * | 12/1990 | Burnside | 493/134 |
| 5,069,021 | A | | 12/1991 | Reil et al. | |
| 5,262,126 | A | | 11/1993 | Shimamura et al. | |
| 5,294,001 | A | * | 3/1994 | Dulin | 209/3 |
| 5,393,294 | A | * | 2/1995 | Jobst | 493/342 |
| 5,704,541 | A | | 1/1998 | Mogard | |
| 6,599,225 | B2 | * | 7/2003 | Ammons et al. | 493/183 |

FOREIGN PATENT DOCUMENTS

| | | |
|---|---|---|
| DE | 19626705 | 1/1998 |
| EP | 0900646 | 3/1999 |
| GB | 957487 | 5/1964 |

* cited by examiner

SYSTEM FOR MANUFACTURING CONTAINERS

This application is the National Phase of International Application PCT/IB2003/003205 filed Jan. 14, 2003 which designated the U.S. and that International Application was published under PCT Article 21(2) in English.

TECHNICAL FIELD

The present invention relates to a system for the manufacture of containers, in particular for preserving food products.

The invention relates also to a method of manufacturing containers, in particular for preserving food products.

BACKGROUND ART

More particularly, the invention finds application in the art field concerned with the manufacture of containers such as bottles and cartons and the like, having a structure fashioned from multilayer or coated paper material and utilized for packaging liquid foods or edible products in general, typically milk, fruit juices, yoghurt, mineral water and other such substances.

It is common practice for containers of the type in question to be manufactured on a system consisting in a number of separate machines by which a selected forming material can be fashioned into a succession of single containers or bottles ready for filling.

The forming material is processed generally by machines that need to be equipped with respective storage units, so that the material emerging from a given machine can be held temporarily before being transferred to the machine on which the next step of the manufacturing process will be performed.

The need to provide a succession of storage units is dictated by the appreciable distance that separates the various machines utilized in the container manufacturing process, and heightened by the different rates at which the forming material advances when transferred from one machine to another. Indeed the strategy adopted in order to be certain that each machine will receive a steady supply of material is to ensure that the relative storage units, positioned normally upstream and downstream of the machines, are maintained as a rule at full capacity in order to avoid repeated stoppages that would otherwise be caused by a lack of material on the infeed side.

It will be appreciated also that the manoeuvres involved in transferring the forming material from one machine to another are performed typically by one or more operators, whose main task is precisely that of minding the storage units.

Notwithstanding the merits of the container manufacturing process outlined above, which affords considerable output potential, there are certain drawbacks attached, principally regarding the overall dimensions and the cost of the manufacturing system, also the speed with which the containers are turned out and the continuity of the process generally.

More exactly, the presence of a succession of machines separated one from another with relative storage units located between one machine and the next dictates that a large area is needed solely in order to accommodate the system and its minimum operating space, that is to say the space needed to ensure optimum movement of the parts associated with each machine and the material transferred from one machine to the next, and the space in which the operators employed to oversee the running of the process can carry out their various tasks.

Naturally, the system described above is typified by notably high commissioning and operating costs, in view both of the continuous maintenance requirements generated by a plurality of separate machines, and of the space needed to accommodate them.

Another consideration is that, by its very logistical nature, the manufacturing system outlined above does not allow operation at particularly high tempos, being subject to frequent pauses attributable to the switches between machines in operation on the one hand, in which the forming material is processed while advancing through the machine, and storage units on the other, in which the material is simply deposited for a given duration in readiness for its transfer to another machine.

The slowing down and frequent interruptions of the manufacturing process do nothing to help reduce the already high overheads, with the result that the end product is penalized by high marketing costs, and these same costs are driven up further by the need to employ operators exclusively for the purpose of transferring the forming material from one machine to another, a task that tends over time to become quite tedious.

The principal object of the present invention is to overcome the drawbacks typical of the prior art, by providing a system for the manufacture of containers, in particular containers for preserving foods, such as will incorporate all of the work stations needed to produce the selfsame containers, guaranteeing compact dimensions overall, achieving a reduction in the costs of producing and the costs of marketing the containers, while continuing to ensure optimum quality of the end product.

Another object of the invention is to speed up the processes by which the container is manufactured, and ensure their continuity.

A further object of the present invention is to automate the manufacturing process and thus relieve operators of tedious tasks like transferring the forming material from one machine to another, so that their activity can be confined to the conventional procedures of controlling, running and/or servicing the system.

DISCLOSURE OF THE INVENTION

These objects and others besides, which will emerge more clearly from the following specification, are substantially realized in a system for manufacturing containers, in particular for preserving foods.

In addition, the stated objects are realized according to the present invention in a method of manufacturing containers, in particular for preserving foods.

BRIEF DESCRIPTION OF DRAWINGS

The invention will now be described in detail, by way of example, with the aid of the accompanying drawings, in which.

DETAILED DESCRIPTION OF THE INVENTION

With reference to the drawings, 1 denotes a system, in its entirety, for manufacturing containers in accordance with the present invention.

Figure 1:
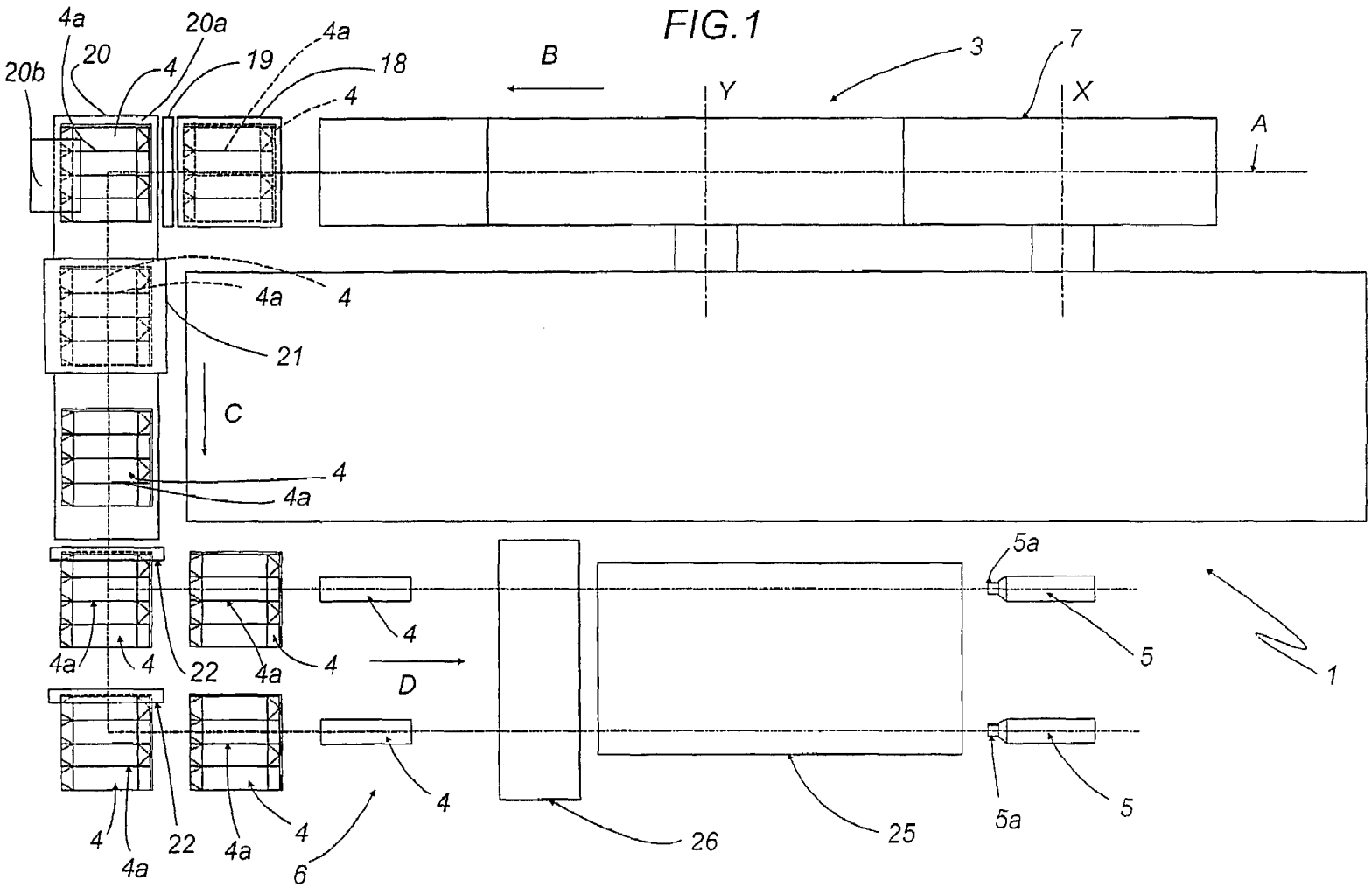
FIG. 1 is a schematic illustration of a system for manufacturing containers according to the present invention, viewed in plan.

As indicated in FIG. 1, the system 1 comprises a supporting structure 2 and, associated with this same structure, a forming sector 3 serving to prepare at least one blank 4 from which to fashion a relative container 5, also a shaping sector 6 operating downstream of the forming sector 3, of which the function is to fold the single blanks 4 emerging from the forming sector 3 and establish the shape of the respective folded containers 5 by means of a fixing operation.

Figure 2:
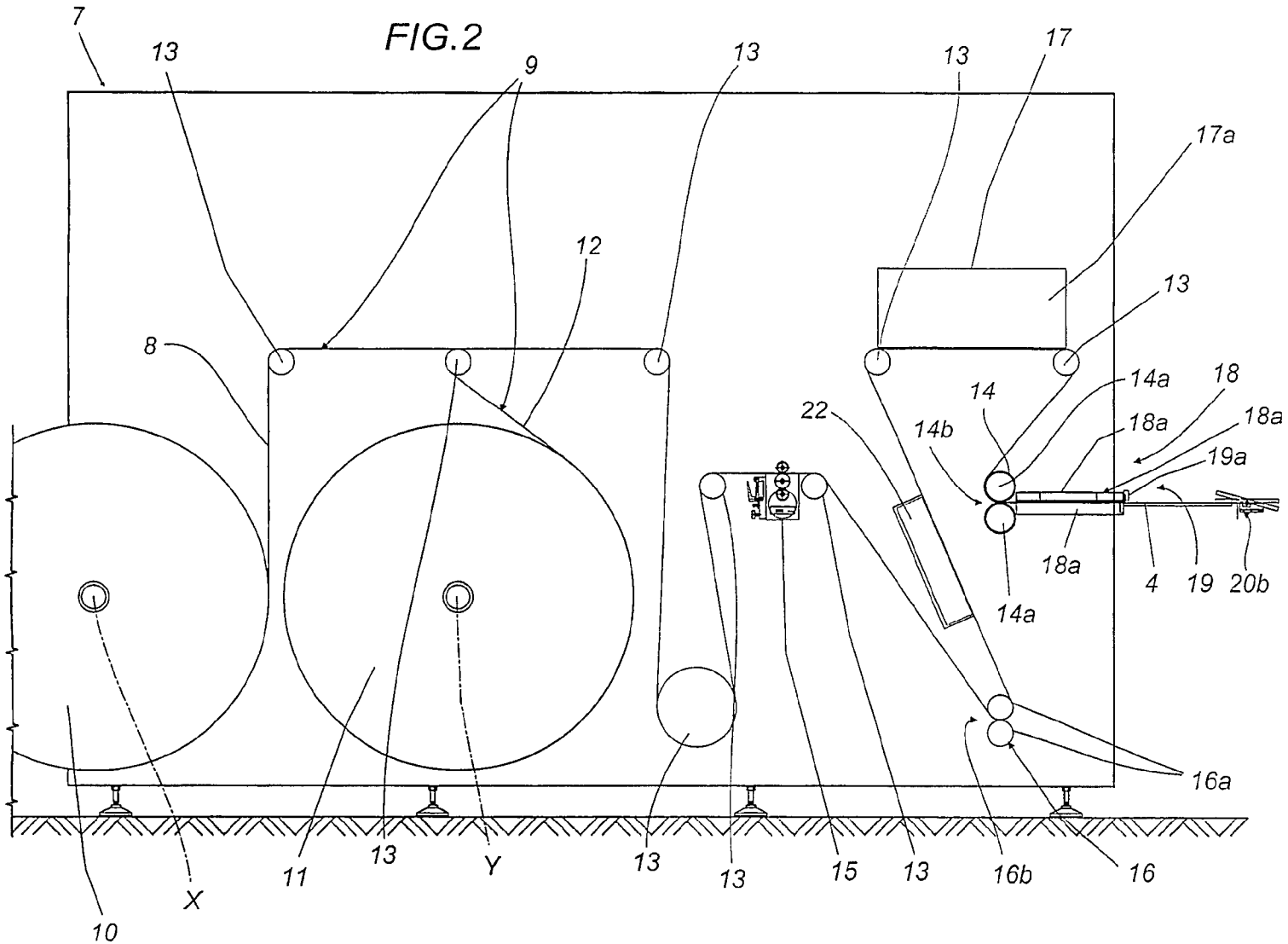
FIG. 2 is a further schematic illustration of the system of FIG. 1, viewed in elevation.

In particular, and referring to FIGS. 1 and 2, the forming sector 3 comprises a feed station 7 by which a continuous strip 8 of forming material 9, suitable for preserving liquid food products, is directed along a predetermined feed path A. The forming material 9 will consist preferably of a multilayer or treated paper material, such as paperboard or cardboard coated with an impermeable and antiseptic film, typically polyethylene.

The aforementioned continuous strip 8 of forming material 9 is preferably carried by and decoilable from a main reel 10 of the feed station 7 rotatable about a relative longitudinal axis X.

As discernible in FIG. 2, the feed station 7 also comprises at least one auxiliary reel 11 rotatable likewise about a relative longitudinal axis Y, from which a relative second strip 12 is decoiled.

The continuous strip 12 decoiled from the auxiliary reel 11 can be spliced in conventional manner to the strip 8 decoiled from the main reel 10, thereby ensuring that the system 1 is guaranteed a continuous supply of forming material 9. In practice, the two continuous strips 8 and 12 will be joined whenever the strip 8 or 12 currently in use is nearing depletion.

More exactly, the trailing end of the continuous strip 8 or 12 currently in use will be cut and spliced to the leading end of a new roll of strip 8 or 12 carried by another reel 10 or 11.

To advantage, each reel 10 or 11 is interchangeable with another reel 10 or 11, so that when the strip 8 or 12 is fully depleted, the empty reel 10 or 11 can be replaced with a full reel 10 or 11.

Still referring to FIGS. 1 and 2, the feed station 7 also comprises a plurality of guide elements 13, consisting preferably in guide rollers, serving to establish a first leg B of the feed path followed by the forming material 9 that extends externally of the supporting structure 2 of the system 1, along a direction substantially parallel to the longitudinal dimension of the selfsame supporting structure.

The system 1 further comprises a traction device 14 operating downstream of the feed station 7, by which the strip 8 or 12 of forming material 9 is taken up directly and drawn from the respective reel 10 or 11 over the aforementioned guide elements 13.

In particular, the traction device 14 comprises a pair of pinch rolls 14*a* positioned mutually tangential and establishing a passage 14*b* through which the forming material 9 is routed by the guide elements 13 of the feed station 7.

To ensure the correct feed motion of the forming material 9, at least one of the two pinch rolls 14*a* of the traction device 14 is coupled to drive means of conventional embodiment (not illustrated) and thus power driven, so that the forming material 9 located upstream of the traction device 14 will be drawn from the respective reel 10 or 11.

Still referring to FIG. 2, the system 1 can be equipped with a numbering device 15 serving to mark consecutive portions of the forming material 9 at points coinciding with the single blanks 4. The numbering device 15 operates between successive guide elements 13 of the feed station 7 in such a way as to mark the forming material 9 at a point along the feed path where the strip extends substantially in a horizontal plane.

The system 1 also comprises a tensioning device 16 positioned and operating upstream of the traction device 14, in such a way that the segment of the forming material 9 advancing downstream of the selfsame device 16 is tensioned longitudinally in order to facilitate certain operations carried out along the first leg B of the feed path A, typically those by which the forming material 9 is creased or scored and then cut into blanks, as will be described in due course.

As indicated in FIG. 2, the tensioning device 16 comprises at least one pair of pinch rolls 16*a* positioned mutually tangential and establishing a passage 16*b* through which the strip of forming material 9 is routed by the guide elements 13 of the feed station 7.

In a preferred embodiment, at least one of the two pinch rolls 16*a* of the tensioning device 16 is subjected to a braking action when in rotation, such as will oppose the action of the traction device 14 and tension the forming material 9 longitudinally along the segment downstream of the device 16, as mentioned above.

As indicated likewise in FIG. 2, the system 1 can include a sterilizing device 17 operating along the first leg B of the feed path A followed by the advancing strip, of which the function is to debacterialize the forming material 9.

More exactly, the sterilizing device 17 comprises at least one ultraviolet lamp 17*a* directed at a substantially horizontal segment of the forming material 9 extending between the tensioning device 16 and the traction device 14.

The sterilization of the forming material 9 might nonetheless be carried out employing any given method and utilizing any conventional sterilizing device. For example, the ultraviolet sterilization method mentioned above might be replaced or supplemented by a sterilization step involving exposure of the forming material 9 to substances such as ozone and/or peroxide agents of various types.

Still in FIG. 2, the forming material 9 decoiling from the reel 10 or 11 currently in use is also subjected to the action of a finishing device 22 operating between the tensioning device 16 and the traction device 14, upstream of the sterilizing device 17. The finishing device 22 operates on a bonding edge 4*b* of the advancing strip 8 or 12, and serves to prepare the selfsame edge 4*b* in such a way that it can be positioned safely on the inside of the formed container 5.

The term "bonding edge" is used to indicate a free lateral edge of the advancing strip 8 or 12, hence a free longitudinal edge of each blank 4 cut from the strip, along which a sealing or welding operation is performed to establish the shape of the resulting container 5, at least in part.

In short, the bonding edge 4*b* constitutes a fixing portion of each blank 4 such as will combine with the main body of the blank in overlapping contact to establish a sealable or weldable area.

Figure 3:
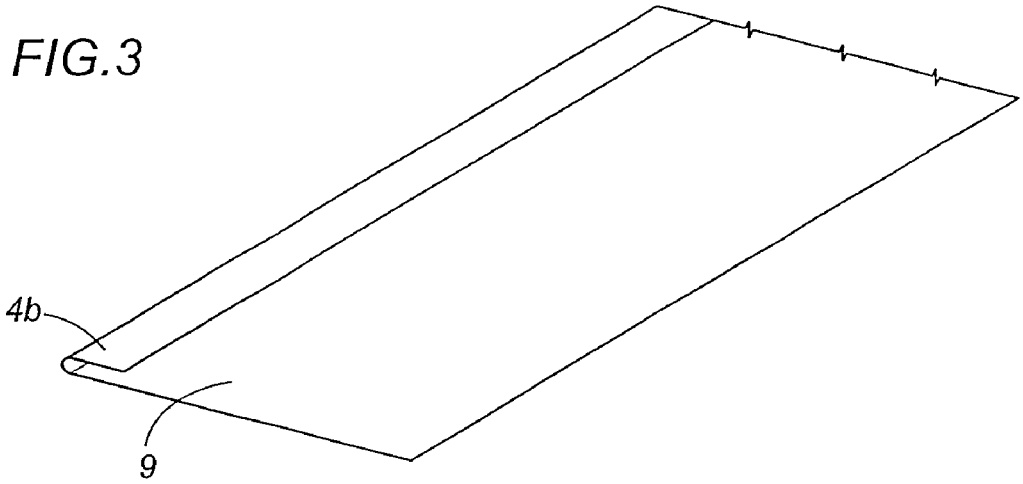
FIG. 3 shows a continuous strip of forming material with a bonding edge utilized by the system of FIGS. 1 and 2, illustrated fragmentarily in perspective and in a first possible embodiment.
Figure 5:
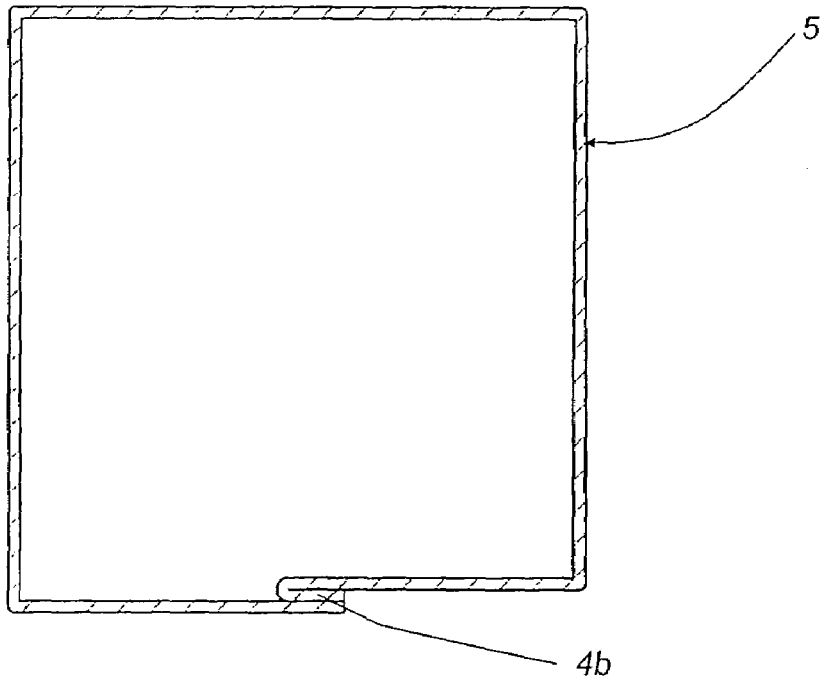
FIG. 5 is a sectional illustration of a container fashioned from the continuous strip of FIG. 3.

In accordance with a first embodiment of the invention (FIG. 3), the finishing device 22 might comprise seam-folding means (not illustrated) by which the bonding edge 4*b* can be bent double longitudinally along its length so that a treated portion of the forming material, having the required properties of hygiene and impermeability, will remain on the inside of the container 5 (FIG. 5).

To this end, the finishing device 22 might also comprise fixing means (non illustrated) consisting preferably in one or more sealing or welding devices, such as will secure the bonding edge 4*b* in the folded position before the material is directed into a further processing station.

Figure 4:
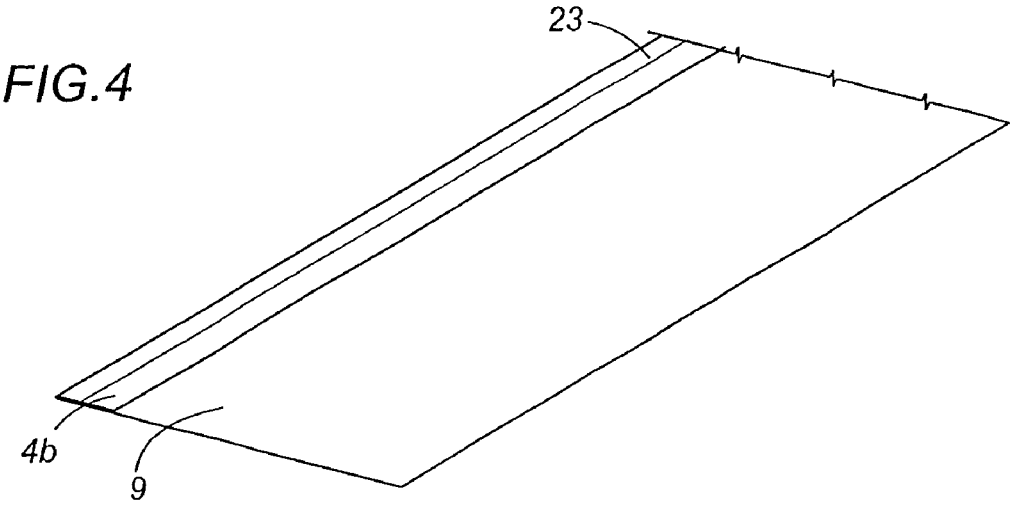
FIG. 4 shows a continuous strip of forming material with a bonding edge utilized by the system of FIGS. 1 and 2, illustrated fragmentarily in perspective and in a second possible embodiment.
Figure 6:
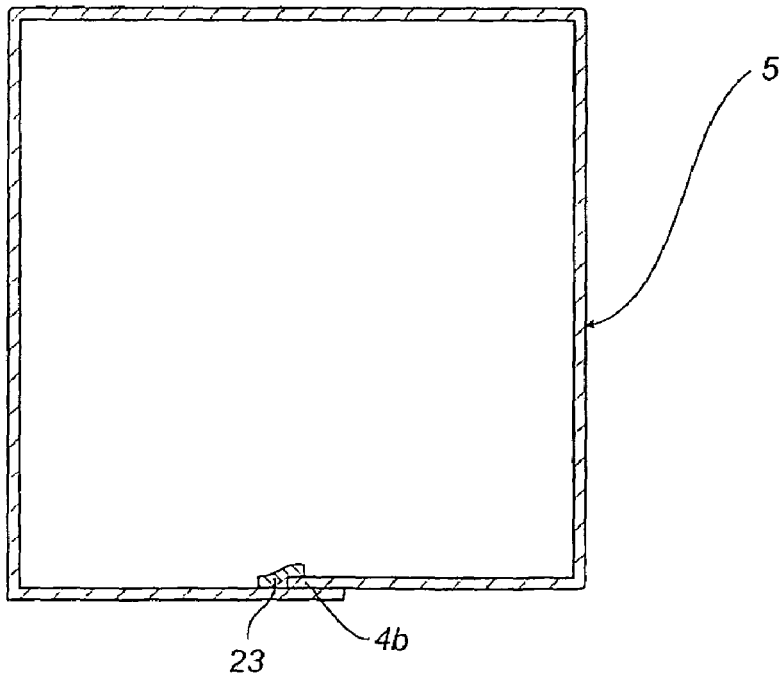
FIG. 6 is a sectional illustration of a container fashioned from the continuous strip of FIG. 4.

In accordance with a second embodiment of the invention (FIG. 4), the finishing device 22 might comprise application means (not illustrated) by which to lay a fillet 23 of treated material along the bonding edge 4*b* of the advancing strip 8 or 12, so that the raw edge of the material 9 will be covered by a portion of treated material having the required properties of hygiene and impermeability, positioned on the inside of the container 5 (FIG. 6).

As illustrated in FIGS. 1 and 2, the forming sector 3 comprises a scoring station 18 positioned downstream of the feed station 7, and more exactly, immediately downstream of the traction device 14, by which each portion of the forming material 9 destined to provide a relative blank 4 is impressed with at least one crease line 4*a*.

In the example of FIG. 2, the scoring station 18 comprises at least one press 18*a* presenting mutually opposed dies 18*b* offered to the two faces of the forming material 9. In operation, the press 18*a* will alternate between an idle position in which the two dies 18*b* are distanced from the forming material 9 interposed between them, and an operating position in which they are brought together forcibly against the forming material 9 in such a way as to generate the crease line, or lines 4*a*.

As an alternative solution to the press 18*a*, the scoring station 18 might comprise at least one pair of tangentially placed rollers (not illustrated) operating from either side on the advancing strip of forming material 9. To produce the crease lines 4*a*, a first roller will afford one or more projections designed to indent the structure of the forming material 9, whilst a second roller or reaction roller will present grooves corresponding in number and matched positionally to the projections presented by the first roller, so that each projection engages a respective groove.

The forming sector 3 also comprises a cutting station 19 operating downstream of the scoring station 18, by which the creased forming material 9 is taken up from this same station 18 and divided into successive discrete pieces, each constituting a respective blank 4. The cutting station 19 comprises at least one blade 19*a* positioned to operate in close proximity to the scoring station 18 so that the forming material 9 can be cut immediately adjacent to the press 18*a*. In operation, like the press, the blade 19*a* alternates between an idle position distanced from the forming material 9, and an operating position of engagement with the selfsame material 9, in which the strip is cut transversely. To advantage, the blade 19*a* can be timed to alternate between the idle position and the operating position synchronously with the movement of the press 18*a* of the scoring station 18 between the idle position and the operating position, so that the press 18*a* and the blade 19*a* are made to engage the forming material 9 simultaneously.

As discernible from FIGS. 1 and 2, the forming sector 3 further comprises at least one transfer device 20 by which each blank 4 emerging from the cutting station 19 is carried toward the shaping sector 6 where it will be fashioned into a relative container 5. In the example illustrated, the transfer device 20 comprises a conveyor belt 20*a*, and one or more gripper elements 20*b* associated with the belt, such as will take up each blank 4 from the cutting station 19 and accompany it along the belt 20*a*.

The conveyor belt 20*a* will extend preferably in a direction perpendicular to the first leg B of the feed path A, establishing a second leg C extending externally of the supporting structure 2, along which the forming material 9 is directed.

At a given point on this same second leg C of the feed path A followed by the forming material 9, the system 1 is equipped with a prefolding station 21 by which blanks 4 emerging from the cutting station 19 are bent initially along the crease lines 4*a* made at the scoring station 18. In particular, the function of the prefolding station 21 is to bend the structure of each successive blank 4 conveyed from the cutting station 19 toward the shaping sector 6 by applying one or more mechanical actions such as will deform the material slightly along the crease lines 4*a*.

More exactly, the step of prefolding each blank 4 is performed by one or more movable folder elements (not illustrated) operating in conjunction with a corresponding number of reaction elements (likewise not illustrated). The folder elements will force the relative portions of the blank 4, whilst the reaction elements will restrain the adjacent portions so as to weaken the structure of the blank 4 along the crease lines 4*a* extending between the forced and restrained portions.

As discernible in FIG. 1, the shaping sector 6 comprises a folding station 24 operating downstream of the transfer device 20, where each blank 4 is bent along the longitudinal crease lines 4*a* in such a way as to take on the shape of a relative container 5, at least in part. In practice, the folding station 24 will be equipped with a set of folder elements (not illustrated) designed to operate on the blanks 4 in combination with one or more reaction elements (not illustrated), for example mandrels of substantially cylindrical geometry, around which the blank 4 is wrapped in such a way as to assume a substantially tubular configuration rendered stable ultimately by fixing the bonding edge 4*b* to the corresponding part of the blank 4.

The shaping sector 6 further comprises a sealing or welding station 25, located downstream of the folding station 24, at which each blank 4 acquires the definitive shape of the container being manufactured. The station 25 in question is furnished preferably with additional folder elements (not illustrated) set up to operate on one end of each tubular blank 4, by which the bottom of the container 5 is formed, and at least one sealer or welder (not illustrated) acting on portions of each container 5 that may require one or more sealed or welded joints.

In the example of FIG. 1, the shaping sector 6 also incorporates at least one assembly device 26 of which the function is to apply a neck 5*a* to one end of each tubular blank 4 emerging from the folding station 24.

The neck 5*a* is fixed to the tubular structure of the folded blank 4 at one end, opposite to the end functioning as the bottom of the container 5. With this purpose in view, it is preferable that the sealing or welding station 25 will include at least two units equipped with respective sealers or welders set up to engage the neck 5*a*, where this is attached to the main body of the blank 4, and to engage other parts of the container 5 such as the bottom.

It will also be observed that the system described thus far, which is designed to prepare blanks 4 from a continuous strip of forming material 9, might operate equally well with forming material 9 procured as a flat tube that can be scored and cut to generate a succession of blanks 4 in similar fashion to the strip forming material 9, or a material having some other initial structural configuration. In this case, naturally enough, the system might present certain differences from the example illustrated, especially in the area of the folding station 24, where the folding steps would be replaced by an erecting step in which the blanks 4 are subjected to a lateral compressing action applied in such a way that the flat profile opens out into a tubular configuration, or in the area of the sealing/welding station 25, where the operation and structure of the sealing or welding equipment will depend exclusively on the type of procedure needed to complete the erection of the blank 4.

With reference to FIG. 1, the shaping sector 6 establishes a third leg D of the feed path A followed by the forming material 9, extending externally of the supporting structure 2 and substantially parallel to the first leg B, in such a way that the path A followed by the forming material 9 circumscribes the selfsame structure 2, at least in part, substantially describing a letter "C".

The system thus described might nonetheless present a substantially linear configuration when viewed in plan, with the forming and shaping sectors 3 and 6 aligned along a substantially rectilinear path. In this instance, were the shaping sector 6 to include two or more shaping lines 6*a*, the forming material 9 would follow a path presenting: a first rectilinear leg extending parallel to the longitudinal dimension of the supporting structure 2; a second leg extending substantially perpendicular to the first, allowing the transfer of the forming material 9 to any one of the single shaping lines 6*a*, which are offset from the first leg; and a third leg parallel to the first leg, along which the forming material 9 proceeds in the same direction as followed along the first leg.

The particular layout of the system 1, presenting stations and devices all associated with the supporting structure 2 to create a single, solid and functional assembly, is characterized further by the inclusion of feed means (not illustrated) such as will ensure the forming material 9 can be transferred from one station or device to the next substantially at a predetermined and uniform tempo, thus ensuring the continuity of the manufacturing process.

The operation of the system 1, described thus far essentially in structural terms, is as follows.

With the traction device 14 activated and running, the system 1 will proceed initially to form the blanks 4, and thereafter to shape them as appropriate for the selected type of container 5. The process is a continuous one, with no breaks between the steps of forming the blanks 4 and shaping the containers 5.

In more detail, during the process of preparing the blanks 4, the forming material 9 carried by the respective reel 10 or 11 currently in use will be drawn by the traction device 14 along the first leg B of the feed path A toward the scoring station 18.

The material is engaged first by the numbering device 15, which marks the strip at regular predetermined intervals to identify the portions that will be separated ultimately into single blanks 4.

Next, the forming material 9 is directed through the rolls 16*a* of the tensioning device 16, which presents a measure of resistance to the advancing motion of the strip, combining thus with the traction device 14 to generate a longitudinal tension that will facilitate the successive steps of scoring and cutting the material 9.

The advancing material 9, and more exactly the face of the material that will be positioned on the inside of the container 5, is then sterilized during the course of its passage from the tensioning device 16 toward the traction device 14.

In addition, and likewise as the forming material 9 is drawn from the tensioning device 16 toward the traction device 14, a finishing operation is performed to the end of preparing the bonding edge 4*b* that will be positioned on the inside of the relative container 5.

In this step, more exactly, the bonding edge 4*b* may undergo two different types of preparation. The first consists in folding the edge double longitudinally against the face of the material 9 opposite the face that will be located ultimately on the inside of the container, then flattening and securing the fold to produce a bonding edge 4*b* of double thickness. The second consists in applying a fillet 23 of treated material to the bonding edge 4*b* along its entire length, without any fold being made.

After the finishing and sterilizing steps, the forming material 9 proceeds through the passage 14*b* afforded by the traction device 14 and toward the scoring station 18.

Once a given portion of the forming material 9, corresponding to one blank 4, is located between the dies 18*b* of the press 18*a* operating at the scoring station 18, the press 18*a* will be caused to move from the idle position to the operating position. The two dies 18*b* of the press 18*a* are consequently drawn together, impinging forcibly on the interposed forming material 9 and impressing it along a set of predetermined crease lines 4*a*.

After the forcing stroke, the press 18*a* will be deactivated and the dies 18*b* drawn apart to release the forming material 9, which can thus advance beyond the cutting station 19 toward the conveyor belt 20*a*. On reaching the conveyor belt 20*a*, the forming material 9 is taken up by one or more gripper elements that will facilitate the operation of cutting through the creased material 9. In effect, as the creased forming material 9 is restrained by the gripper elements 20*b* of the transfer device 20, the blade 19*a* of the cutting station 19 is caused to move from the idle position to the operating position, slicing through the material in close proximity to the scoring station 18 and separating the creased portion, now a formed blank 4, from the forming material 9 subsequently inserted between the dies 18*b* of the press 18*a*. Advantageously, the forcing stroke of the press 18*a* is timed to occur simultaneously with the cutting stroke of the blade 19*a*, in such a way that each newly creased portion of forming material 9 is separated from the successive portion as the successive portion is creased in its turn.

Each blank 4 formed in this way is transferred along the second leg C of the feed path A and toward the shaping sector 6, passing through the prefolding station 21 in which the blank 4 is bent initially along the crease lines 4*a*.

The blank 4 now advances along the third leg D to the folding station 24, where it is bent along the crease lines 4*a* to assume the definitive shape of the selected container 5 at least in part.

Next, the blank 4 undergoes at least one sealing or welding operation as a result of which the shape of the selected container 5 created by bending the blank is fixed and thus made permanent. In the event of the container being fitted with a separately embodied neck 5*a*, this obviously will be assembled prior to the sealing or welding step and fixed permanently to the body of the container as part of this same step.

All of the sealing or welding steps executed as part of the method described above can be carried out using any given conventional method, which preferably would include heat-sealing, ultrasonic welding and/or induction welding.

The problems associated with the prior art and the stated objects are respectively overcome and realized in accordance with the present invention.

First and foremost, the containers manufactured by the system according to the invention are of optimum quality, both from the structural standpoint and from that of their intended use, namely preserving foods.

Furthermore, the system described and illustrated features a single structure incorporating all of the stations and devices needed to fashion the containers. In particular, the system 1 disclosed is characterized by notably compact dimensions, which result in a considerable saving of space that will also translate into cost savings, unlike solutions typical of the prior art which call for much larger spaces due to the appreciable distances between one station and another and the extensive use of storage units between the stations in which to hold the forming material.

In addition, the containers are turned out quickly and with no interruptions resulting from the need to transfer material from one station to another, as the material is transferred along the feed path A automatically.

It will also be appreciated that single containers are manufactured by the system 1 from start to finish, without the need for any action on the part of operators, who instead can concentrate fully on the procedures of controlling, running and/or servicing the system, which are decidedly less tedious than the repetitive tasks of transferring material from one station to another.

The invention claimed is:

1. A system for manufacturing containers, comprising a supporting structure, the system being composed entirely of parts associated with the supporting structure, including:

a forming sector supplied, by a feed station, with a continuous strip of forming material, comprising at least a paper material, used in the preparation of at least one blank from which to fashion a respective container, and establishing a first leg of a feed path followed by the material;

a transfer device operating downstream of the forming sector, serving to distance the forming material from the forming sector and establishing a second leg of the feed path followed by the material; and a shaping sector operating downstream of the forming sector, by which each blank emerging from the sector is folded and caused ultimately by means of a fixing operation to assume the shape of the container produced by the folding step, the shaping sector establishing a third leg of the feed path followed by the forming material;

a traction device operating by direct interaction with the forming material at a point downstream of the feed station;

at least one tensioning device, operating upstream of the traction device and in such a manner that the segment of forming material extending downstream of the tensioning device is subjected to a predetermined longitudinal tension, in order to facilitate certain operations carded out along the first leg;

a finishing device, operating between the tensioning device and the traction device, associated with the feed station and designed to operate on at least one bonding edge of the advancing forming material in such a way that the bonding edge of the single blank is bent double along its length and rendered suitable for positioning on the inside of the relative container;

the first leg of the feed path extending substantially parallel to the longitudinal dimension of the supporting structure;

the second leg of the feed path extending transversely to the first leg;

the third leg of the feed path extending substantially parallel to the first leg and transversely to the second leg; and the first, second and third legs being disposed in such a manner that the forming material will follow a feed path extending externally of the supporting structure at least in part, and presenting substantially a C-shaped configuration by which the supporting structure is circumscribed at least in part.

2. The system as in claim 1, wherein the forming sector and the shaping sector are arranged in line operationally, so that the path followed by the forming material when advancing between the forming sector and the shaping sector is substantially linear.

3. The system as in claim 2, wherein the shaping sector comprises at least two substantially parallel shaping lines onto which the forming material emerging from the forming sector is directed.

4. The system as in claim 3, wherein the forming sector comprises:

the feed station supplying the forming material;

a cutting station operating downstream of the feed station, by which the forming material is divided into a succession of discrete lengths each constituting a respective blank;

a scoring station operating downstream of the feed station, by which at least one crease line is applied to each length of forming material constituting a blank; and a preforming station operating downstream of the feed station, by which the forming material is bent initially along the crease line.

5. The system as in claim 4, wherein the feed station comprises at least one main supply reel carrying a coiled continuous strip of the forming material and rotatable about a respective longitudinal axis in such a way that the continuous strip of forming material can be decoiled.

6. The system as in claim 4, wherein the first leg of the feed path followed by the forming material is established by a plurality of guide elements constituting part of the feed station.

7. The system as in claim 4, wherein the preforming station operates at a point on the second leg of the feed path downstream of the cutting station, in such a manner as to initiate a bend in the length of forming material constituting each blank along the relative crease fine generated by the scoring station.

8. The system as in claim 5, wherein the feed station comprises at least one auxiliary supply reel carrying a further continuous strip of the forming material that can be spliced to the continuous strip of the main reel to guarantee continuity of the supply of forming material, each supply reel being replaceable, on final depletion of the relative forming material, with a further reel carrying a fresh supply of the forming material.

9. The system as in claim 5, wherein the traction device, operating by direct interaction with the forming material at a point downstream of the feed station, serves to decoil the selfsame material from the relative supply reel.

10. The system as in claim 9, wherein the traction device comprises a pair of pinch rolls, positioned mutually tangential and establishing a passage through which the forming material is directed, including at least one roll that can be power driven in rotation to the end of advancing the forming material through the passage of the device.

11. The system as in claim 1, wherein the tensioning device comprises at least one pair of pinch rolls, positioned mutually tangential and establishing a passage through which the forming material is directed, including at least one roll subjected to a braking action when in rotation in such a way as to tension the forming material advancing through passage of the device.

12. The system as in claim 1, comprising at least one sterilizing device operating along the feed path followed by the forming material and serving to debacterialize the selfsame material.

13. The system as in claim 12, wherein the sterilizing device operates on the forming material at a point between the tensioning device and the traction device.

14. The system as in claim 1, wherein the scoring station is positioned to operate at a point along the feed path followed by the forming material, between the feed station and the cutting station.

15. The system as in claim 14, wherein the scoring station comprises at least one press presenting mutually opposed dies offered to the two faces of the forming material, capable of alternating between an idle position in which the dies are distanced from the forming material interposed between them, and an operating position in which they are brought together forcibly against the forming material in such a way as to generate the crease line.

16. The system as in claim 15, wherein the cutting station comprises at least one blade positioned to operate in close proximity to the scoring station in such a way that the forming material can be cut immediately adjacent to the press, capable of alternating between an idle position distanced from the forming material, and an operating position of engagement with the selfsame material, in which a blank is separated.

17. The system as in claim 16, wherein the blade of the cutting station can be timed to alternate between the idle position and the operating position synchronously with the movement of the press of the scoring station between the relative idle position and operating position, in such a manner that the press of the scoring station and the blade of the cutting station are made to engage the advancing forming material simultaneously.

18. The system as in claim 1, wherein the transfer device comprises at least one gripper element serving to take up each blank of forming material released from the cutting station, and capable of movement along the second leg of the feed path between the cutting station and the shaping sector to the end of advancing each successive blank.

19. The system as in claim 1, wherein the finishing device comprises: seam-folding means by which the bonding edge is bent double along its length in such a way that the bonding edge of each blank will present a treated portion directed toward the inside of the relative container; also fixing means by which to secure the bonding edge in the bent configuration.

20. The system as in claim 1, wherein the finishing device comprises application means by which to lay a fillet of treated material over the raw edge of the advancing material, so that the bonding edge of each blank will be covered by a layer of material suitable for positioning on the inside of the relative container.

21. The system as in claim 1, wherein the shaping sector comprises: a folding station at which each blank is bent along the crease lines in such a way as to take on the shape of the container being manufactured, and a sealing or welding station located downstream of the folding station, where each blank is secured in the configuration presented on emerging from the folding station to assume the definitive shape of the relative container.

22. The system as in claim 21, wherein the sealing or welding station comprises at least one sealer or welder such as will fix each blank in the definitive configuration of the manufactured container.

23. The system as in claim 22, further comprising an assembly station operating between the folding station and the sealing or welding station and sewing to apply at least one neck to each folded blank emerging from the folding station, wherein each neck is fixed to the folded blank at the sealing or welding station through the agency of the sealer or welder.

24. The system as in claim 1, further comprising feed means associated with the supporting structure and sewing to guarantee the movement of the forming material between the stations of the system, wherein such means comprise the transfer device and cause the forming material to pass from one station to the next substantially at a predetermined and uniform time.

* * * * *